US011280227B2

(12) United States Patent
Mazur et al.

(10) Patent No.: US 11,280,227 B2
(45) Date of Patent: Mar. 22, 2022

(54) METHOD FOR ADAPTATION OF A DETECTED CAMSHAFT POSITION, CONTROL UNIT FOR CARRYING OUT THE METHOD, INTERNAL COMBUSTION ENGINE, AND VEHICLE

(71) Applicant: VOLKSWAGEN AKTIENGESELLSCHAFT, Wolfsburg (DE)

(72) Inventors: Michael Mazur, Hannover (DE); Jens Jeschke, Braunschweig (DE); Johannes Forst, Hannover (DE); Holger Blume, Hannover (DE); Nico Gerhardt, Sassenburg (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 102 days.

(21) Appl. No.: 16/995,370

(22) Filed: Aug. 17, 2020

(65) Prior Publication Data

US 2021/0047946 A1 Feb. 18, 2021

(30) Foreign Application Priority Data

Aug. 15, 2019 (DE) ..... 10 2019 212 275.2

(51) Int. Cl.
*F01L 1/04* (2006.01)
*F01L 1/34* (2006.01)
(Continued)

(52) U.S. Cl.
CPC ..... *F01L 1/047* (2013.01); *F01L 1/46* (2013.01); *F01L 2201/00* (2013.01);
(Continued)

(58) Field of Classification Search
CPC ..... F02D 41/009; F02D 41/1405; F02D 41/0085; F02D 41/1406; F02D 41/2474;
(Continued)

(56) References Cited

U.S. PATENT DOCUMENTS 6,446,605 B1 9/2002 Fehrmann et al.
6,488,008 B1 12/2002 Jankovic et al.
(Continued)

FOREIGN PATENT DOCUMENTS

CN 103699035 B 2/2015
CN 102913334 B 6/2015
(Continued)

*Primary Examiner* — Long T Tran
(74) *Attorney, Agent, or Firm* — Muncy, Geissler, Olds & Lowe, P.C.

(57) ABSTRACT

A method for adaptation of a detected camshaft position of a camshaft in an internal combustion engine with: Detection of an ACTUAL gas signal in a gas space that is associated with the camshaft and is associated with a detected camshaft position; Processing of the gas signal to produce an ACTUAL gas criterion; Modeling of multiple simulated gas criteria, each of which is associated with a target camshaft position; Determination of a simulated gas criterion with the least deviation from the ACTUAL gas criterion; Determination of an ACTUAL camshaft position that corresponds to the simulated gas criterion with the least deviation from the ACTUAL gas criterion; Determination of a camshaft position correction value from the difference between the ACTUAL camshaft position determined and the detected camshaft position; Determination of corrected camshaft positions by correcting the detected camshaft positions with the camshaft position correction value.

15 Claims, 3 Drawing Sheets

(51) Int. Cl.

| | |
|---|---|
| ***F02D 41/00*** | (2006.01) |
| ***F01L 1/047*** | (2006.01) |
| ***F01L 1/46*** | (2006.01) |

(52) U.S. Cl.

CPC ... *F01L 2820/041* (2013.01); *F01L 2820/042* (2013.01); *F01L 2820/043* (2013.01)

(58) Field of Classification Search

CPC ..... F01L 1/047; F01L 1/344; F01L 2201/00; F01L 2800/09; F01L 2820/041; F01L 2820/042

See application file for complete search history.

(56) References Cited

U.S. PATENT DOCUMENTS

| | | | | |
|---|---|---|---|---|
| 6,550,451 | B1 | 4/2003 | Müller et al. | |
| 6,804,997 | B1 | 10/2004 | Schwulst | |
| 6,827,063 | B2 | 12/2004 | Breitegger et al. | |
| 6,871,632 | B2 | 3/2005 | Henn et al. | |
| 6,915,788 | B2 | 7/2005 | Nakamura | |
| 6,978,666 | B1 | 12/2005 | Wu et al. | |
| 7,036,472 | B2 | 5/2006 | Mencher et al. | |
| 7,058,501 | B2 | 6/2006 | Yasui et al. | |
| 7,093,573 | B2 | 8/2006 | Kunz et al. | |
| 7,117,080 | B2 | 10/2006 | Sobel | |
| 7,162,356 | B2 | 1/2007 | Fuwa et al. | |
| 7,212,912 | B2 | 5/2007 | Okubo et al. | |
| 7,213,550 | B2 | 5/2007 | Nishida | |
| 7,302,835 | B2 | 12/2007 | Galtier et al. | |
| 7,305,950 | B1 | 12/2007 | Sinnamon | |
| 7,376,506 | B2 | 5/2008 | Schueler | |
| 7,451,036 | B2 | 11/2008 | Fuwa et al. | |
| 7,454,954 | B2 | 11/2008 | Taglialatela et al. | |
| 7,703,441 | B2 | 4/2010 | Hathout et al. | |
| 7,810,460 | B2 | 10/2010 | Ruiz | |
| 7,830,749 | B2 | 11/2010 | Kyllingstad | |
| 7,832,259 | B2 | 11/2010 | Wang et al. | |
| 7,891,347 | B2 | 2/2011 | Eser et al. | |
| 7,921,700 | B2 | 4/2011 | Raichle et al. | |
| 7,930,093 | B2 | 4/2011 | Bauer et al. | |
| 7,991,488 | B2 | 8/2011 | Viele | |
| 8,000,875 | B2 | 8/2011 | Klein et al. | |
| 8,086,385 | B2 | 12/2011 | Ogawa et al. | |
| 8,140,174 | B2 | 3/2012 | Yasui | |
| 8,739,616 | B2 | 6/2014 | Wagner et al. | |
| 8,857,409 | B2 | 10/2014 | Lee | |
| 8,977,470 | B2 | 3/2015 | Leone et al. | |
| 9,026,338 | B2 | 5/2015 | Iwatani | |
| 9,217,387 | B2 | 12/2015 | Loeffler et al. | |
| 9,273,656 | B2 | 3/2016 | Schule et al. | |
| 9,435,277 | B2 | 9/2016 | Garrard et al. | |
| 9,605,607 | B2 | 3/2017 | Elsner et al. | |
| 9,657,670 | B2 | 5/2017 | Wu et al. | |
| 9,810,161 | B2 | 11/2017 | Fiorini et al. | |
| 10,012,156 | B2 | 7/2018 | Rauscher et al. | |
| 10,151,253 | B2 | 12/2018 | Kaisser et al. | |
| 10,337,416 | B2 | 7/2019 | Surnilla | |
| 10,415,494 | B2 | 9/2019 | Braun et al. | |
| 10,450,977 | B2 | 10/2019 | Kainz et al. | |
| 10,472,999 | B2 | 11/2019 | Pedro et al. | |
| 10,570,831 | B2 | 2/2020 | Braun et al. | |
| 10,584,650 | B2 | 3/2020 | Braun et al. | |
| 10,669,965 | B2 | 6/2020 | Braun et al. | |
| 10,711,717 | B2 | 7/2020 | Braun | |
| 10,718,283 | B2 | 7/2020 | Braun | |
| 10,774,758 | B2 | 9/2020 | Moik et al. | |
| 10,788,396 | B2 * | 9/2020 | Attard | F02P 5/1502 |
| 2003/0097214 | A1 * | 5/2003 | Gross | F02D 41/0062 701/103 |
| 2010/0063775 | A1 | 3/2010 | Colling | |
| 2011/0093182 | A1 | 4/2011 | Weber et al. | |
| 2011/0137509 | A1 | 6/2011 | Sarac | |
| 2012/0290189 | A1 * | 11/2012 | Davis | F02D 15/00 701/102 |
| 2015/0308360 | A1 | 10/2015 | Knafl et al. | |
| 2017/0082055 | A1 | 3/2017 | Cygan, Jr. et al. | |
| 2018/0045126 | A1 * | 2/2018 | He | F02D 11/105 |
| 2018/0058350 | A1 * | 3/2018 | Zhu | F02M 26/01 |
| 2018/0274397 | A1 * | 9/2018 | Pochner | F02D 13/02 |
| 2019/0242305 | A1 | 8/2019 | Burkhardt et al. | |
| 2020/0063674 | A1 | 2/2020 | Braun et al. | |

FOREIGN PATENT DOCUMENTS

| | | | |
|---|---|---|---|
| CN | 103149032 | B | 6/2015 |
| DE | 10115262 | C2 | 4/2003 |
| DE | 10224213 | C1 | 10/2003 |
| DE | 10344773 | B3 | 5/2005 |
| DE | 10360333 | A1 | 7/2005 |
| DE | 102004043365 | A1 | 3/2006 |
| DE | 102004054711 | A1 | 5/2006 |
| DE | 102007035314 | A1 | 1/2009 |
| DE | 10237221 | B4 | 6/2009 |
| DE | 102007061226 | A1 | 6/2009 |
| DE | 102008004442 | B3 | 7/2009 |
| DE | 102005042794 | B4 | 8/2009 |
| DE | 102008001099 | A1 | 10/2009 |
| DE | 102006013501 | B4 | 12/2009 |
| DE | 102004001102 | B4 | 1/2010 |
| DE | 102009027400 | A1 | 1/2011 |
| DE | 102009043431 | A1 | 3/2011 |
| DE | 102007024416 | B4 | 1/2012 |
| DE | 102010041999 | A1 | 4/2012 |
| DE | 102010041119 | B4 | 4/2013 |
| DE | 102010027215 | B4 | 9/2013 |
| DE | 102012212860 | B3 | 12/2013 |
| DE | 102013206608 | A1 | 10/2014 |
| DE | 102014203687 | B3 | 3/2015 |
| DE | 102014223136 | A1 | 5/2015 |
| DE | 102014000396 | A1 | 7/2015 |
| DE | 102004047945 | B4 | 8/2015 |
| DE | 102014214438 | B3 | 8/2015 |
| DE | 102011081157 | B4 | 10/2015 |
| DE | 102014207270 | A1 | 10/2015 |
| DE | 102015209665 | A1 | 12/2015 |
| DE | 102015200472 | A1 | 7/2016 |
| DE | 112009001425 | B4 | 7/2016 |
| DE | 102015203637 | A1 | 9/2016 |
| DE | 102015226138 | B3 | 12/2016 |
| DE | 102015213933 | A1 | 1/2017 |
| DE | 102015215566 | A1 | 2/2017 |
| DE | 102015222408 | B3 | 3/2017 |
| DE | 102016116852 | A1 | 3/2017 |
| DE | 102016117939 | A1 | 4/2017 |
| DE | 102015221203 | A1 | 5/2017 |
| DE | 102004026006 | B4 | 6/2017 |
| DE | 102015226461 | A1 | 6/2017 |
| DE | 102016219582 | B3 | 6/2017 |
| DE | 102011052224 | B4 | 7/2017 |
| DE | 102016200782 | A1 | 7/2017 |
| DE | 102015226446 | B4 | 8/2017 |
| DE | 102016203759 | A1 | 9/2017 |
| DE | 102017118624 | A1 | 2/2018 |
| DE | 102016216652 | A1 | 3/2018 |
| DE | 102016217222 | A1 | 3/2018 |
| DE | 102016219584 | B4 | 5/2018 |
| DE | 102016222533 | B4 | 7/2018 |
| DE | 102017000399 | A1 | 7/2018 |
| EP | 0429819 | B1 | 3/1993 |
| EP | 1470333 | B1 | 4/2006 |
| EP | 1611318 | B1 | 3/2007 |
| EP | 1402165 | B1 | 4/2009 |
| EP | 2162802 | B1 | 10/2010 |
| EP | 1518051 | B1 | 1/2012 |
| EP | 1669822 | B1 | 1/2012 |
| EP | 2397673 | B1 | 4/2013 |
| EP | 2492475 | B1 | 5/2014 |
| EP | 2929167 | B1 | 10/2016 |
| EP | 2551495 | B1 | 1/2018 |
| FR | 2993358 | B1 | 6/2015 |
| JP | 3812633 | B2 | 8/2006 |

(56) References Cited

FOREIGN PATENT DOCUMENTS

| | | | |
|---|---|---|---|
| KR | 101574668 | B1 | 12/2015 |
| WO | WO2008/140405 | A1 | 11/2008 |
| WO | WO2018060339 | A1 | 4/2018 |

* cited by examiner

METHOD FOR ADAPTATION OF A DETECTED CAMSHAFT POSITION, CONTROL UNIT FOR CARRYING OUT THE METHOD, INTERNAL COMBUSTION ENGINE, AND VEHICLE

This nonprovisional application claims priority under 35 U.S.C. § 119(a) to German Patent Application No. 10 2019 212 275.2, which was filed in Germany on Aug. 15, 2019, and which is herein incorporated by reference.

BACKGROUND OF THE INVENTION

Field of the Invention

The present invention relates to a method for adaptation of a detected camshaft position of a camshaft in an internal combustion engine. The invention further relates to a control unit that is equipped and designed to carry out such a method, and also to an internal combustion engine with which this method can be carried out, as well as to a vehicle having such an internal combustion engine.

Description of the Background Art

In modern internal combustion engines, especially in gasoline engines, increasing use is being made of adjustable camshafts and valve control systems for exact air control. As a result, it has become possible in the meantime to flexibly configure the control phases, the control times, and the control profiles of the intake and exhaust valves.

For adjustment of the control phases, so-called camshaft phasers are used here, which make the angles of the control cams on the camshaft possible through continuous adjustment. Complementary variable valve control systems (for example, the known, so-called Valvetronic) additionally make possible a variation of the valve stroke and a simultaneous change in the opening period.

In this way, largely unthrottled combustion methods such as the Miller cycle concept are also being increasingly implemented, namely in addition to the normal Otto cycle. In this context, "unthrottled" can mean that the air charge can be largely decoupled from the actuation of the throttle valve and is accomplished exclusively through the control of the intake and/or exhaust valves.

As such engine concepts (camshaft-controlled and variable valve control systems) become increasingly widespread, however, the requirements intensify for accuracy of the setting of the camshaft itself and of the valve adjustment mechanisms. Because the camshafts are driven directly by the crankshaft, even small deviations from the target position intended for a specific cylinder charge lead to significant deviations in the load-dependent specific cylinder charge, and thus to unfavorable emissions effects and operating states.

In order to ensure that the exact angular position of the cams or of the camshafts is known in relationship to the intake and exhaust valves or in relationship to the crankshaft position, very accurate crankshaft and camshaft sensor arrangements are provided, which detect position, rotation, and location relative to one another in an accurate and highly dynamic manner. Reference systems are used for calibration. Additionally, both the camshafts themselves and the associated sensor arrangements can be measured with high accuracy during production and after assembly. Production-related deviations can be detected and compensated in this way. Correction data for compensation can be stored individually in the engine control unit. In this way, the necessary positions and locations of the camshaft can be detected accurately in operation. In the load-dependent control of the adjustment mechanisms of the camshaft and the valves, the associated gas control can be accurately set during load change (fresh gas delivery, exhaust removal). In particular, in this way the cylinder charge or the gas quantity (also fresh gas quantity or fresh air quantity) can always be better controlled in a load-dependent manner and, for certain methods, largely unthrottled.

The disadvantage or the problem nonetheless exists that, in the event of small deviations in the components (sensors, transfer elements, adjusters, etc.) that are calibrated and matched to one another, deviations in position occur, which adversely affect gas exchange control and, in particular, the setting of the quantity of fresh gas or air. As a result, this means that the desired air quantity is not provided for a requested operating load. The same problem also arises when essential components of the drive train that work together for control of the air quantity are replaced. These components include transfer elements such as chains, gears, and belts, as well as the sensor arrangements that detect the position and direction of rotation of the crankshaft or camshaft and transmit them to an engine control unit.

In order to ensure optimal load-dependent gas quantity control, it can be useful to re-measure the components accurately and to match them to one another after every rebuild. It is also possible to specify the installation of more accurate components as part of maintenance, or to design the application or the engine to be sufficiently "emissions robust" that certain deviations are tolerable.

Another approach can also is in identifying such positional changes from the analysis of operating data of the engine and compensating them through control technology.

For this purpose, there is an approach in DE 10 2016 219 584 B4, which corresponds to U.S. Pat. No. 10,711,717, in which the combined identification of an intake valve stroke phase difference and an exhaust valve stroke phase difference of a cylinder of an internal combustion engine is based on the means that the phase position and the amplitude of a selected signal frequency of the pressure pulsations in the intake air in the air intake tract are identified with respect to a crankshaft phase angle signal from the dynamic pressure pulsations in the intake air that can be associated with the relevant cylinder. On the basis of these phase positions and amplitudes, the intake valve stroke phase difference and the exhaust valve stroke phase difference are then determined with the aid of lines of equal phase position and lines of equal amplitude. This method is intended to perform an identification of the control times in a simple and economical manner.

A similar method is known from DE 10 2016 222 533 B4, which corresponds to US 2020/0063674. Here, deviations in the valve train of the internal combustion engine are detected and controlled accordingly in that an intake valve stroke phase difference and/or an exhaust valve stroke phase difference are identified by analysis of dynamic pressure pulsations in the intake air in the air intake tract of the relevant internal combustion engine in operation, and from this a valve stroke phase deviation value is determined with respect to a valve stroke phase reference value, and a first deviation value of the valve train is identified on the basis thereof.

Both methods make it possible in principle to identify phase differences that can occur during operation of an engine. They also permit compensation of such a phase difference using control technology.

One problem with these approaches, however, is that the accuracy of the compensation can only be judged with difficulty, and thus it may only be possible to ensure to a limited extent that the correction value is in fact suitable for adequately compensating a phase difference.

SUMMARY OF THE INVENTION

It is therefore an object of the present invention to provide a method for adaptation of a detected camshaft position of a camshaft in an internal combustion engine with which the abovementioned disadvantages are at least partially overcome.

The method according to the invention for adaptation of a detected camshaft position of a camshaft in an internal combustion engine is characterized by the following:

Detection of an ACTUAL gas signal in a gas space that is associated with the camshaft and is associated with a detected camshaft position, Processing of the gas signal to produce an ACTUAL gas criterion, Modeling of multiple simulated gas criteria, each of which is associated with a camshaft position (in particular, a target camshaft position), Comparison of the simulated gas criteria with the ACTUAL gas criterion, Determination of a simulated gas criterion with the least deviation from the ACTUAL gas criterion, Determination of an ACTUAL camshaft position that corresponds to the simulated gas criterion with the least deviation from the ACTUAL gas criterion, Determination of a camshaft position correction value from the difference between the ACTUAL camshaft position determined and the detected camshaft position, and Determination of corrected camshaft positions by correcting the detected camshaft positions with the camshaft position correction value.

The method uses the relationship between a camshaft position—and the positions of the intake and exhaust valves that are directly dependent thereon—and the gas state in a gas space located upstream of the combustion chamber of the internal combustion engine or in a downstream gas space, namely the air intake tract or the exhaust tract. These tracts are connected to the combustion chamber by the intake or exhaust valves, respectively.

In this context, the term "camshaft position" can refer to the position of an adjustable camshaft that affects the control (phase position, control time, control profile) of a controlled valve, and not to the rotational position in operation that depends on the angular position of a driving crankshaft.

Here, the detection of an ACTUAL gas signal includes the sensing of a gas variable or of a gas variable behavior in the air intake tract or in the exhaust tract. Such a gas variable can be, for example, the intake pressure $p_2$ or the exhaust gas back pressure $p_3$ or the gas volume flow rates $V_2$ or $V_3$ occurring there. Other gas variables can also include the temperatures $T_2$ or $T_3$ upstream or downstream of the combustion chamber or other gas properties such as flow velocity and density.

For optimal operation of the internal combustion engine with respect to emissions, fuel consumption, performance, running smoothness, etc., it is desirable to determine precisely the gas charge introduced into the combustion chamber. In this way, the additional parameters for optimal combustion can be matched, in particular the fuel quantity to be delivered or directly injected. The charge exchange, in which the fresh gas is drawn in or delivered and the exhaust gas is discharged or removed, depends on the control times, control profiles, and control phases of the intake and exhaust valves, among other factors.

The behavior over time of the relevant valve strokes is controlled through the crankshaft correlated in time with the behavior of the actual piston stroke. The charge exchange becomes dependent in operation on the positions of the intake and exhaust valves in relation to the crankshaft phase angle, and thus in relation to the position of the reciprocating piston.

In order to be able to set the gas charge or the charge exchange optimally for each operating point, the requisite control parameters are detected through measurement of a reference engine in the operating states that occur. Typical operating states here are rotational speed and load, which are detected and stored with the associated valve timing and any supplementary operating parameters of exhaust turbochargers or other charging devices. A reference data set is derived therefrom, which includes the particular desired air charge as a function of the associated valve timing and camshaft phasers. In other words, for each camshaft position or a camshaft phase position, a typical gas variable is identified that characterizes the required gas charge. The same also applies to a corresponding gas variable for exhaust gas discharge. Manufacturing tolerances and deviations between the reference engine and the production internal combustion engine in question can be compensated by correction values that can be permanently set.

Deviations of the actual positions of the intake and exhaust valves relative to the crankshaft phase angle or the reciprocating piston position from the ideal reference positions can occur during operation or due to replacement of major components. These deviations alter the gas exchange or charge exchange. This causes the actual fresh gas charge to deviate from the fresh gas charge identified as the reference. This means that the control parameters must be corrected in order to compensate adverse effects with respect to emissions, fuel consumption, performance, running smoothness, etc.

According to the invention, for this purpose an ACTUAL gas signal is detected that is associated with a detected camshaft position. The ACTUAL gas signal here can also be a gas signal behavior over a specific period of time, for example one crankshaft rotation or one complete combustion cycle, so that a complete gas signal profile that correlates with a specific camshaft position is detected.

For simplified subsequent processing, this ACTUAL gas signal is compressed or simplified to produce an ACTUAL gas criterion. For example, signal processing algorithms such as an FFT filter (Fast Fourier Transform filter), a bandpass filter, or the like, can be used for conversion of the ACTUAL gas signal into an ACTUAL gas criterion. In all these methods, the raw signal data are reduced so that the characteristic relationships between the signal and the camshaft behavior or the valve behavior are preserved, but the quantity of data is reduced enough that processing and storage are simplified.

In another step, simulated gas criteria that have the same characteristics as the ACTUAL gas criterion are then modeled. These simulated criteria may also be criteria behaviors that correlate with the corresponding behaviors of the camshafts or of the intake or exhaust valves. These simulated gas criteria are then varied in that the criteria for different camshaft positions are modeled so that there is a family of simulated gas criteria, each of which belongs to one specific camshaft position.

The variation is accomplished in that a virtual, relative adjustment of the camshaft (phase) takes place at a specific crankshaft angle, for example. As a result, the control phases relative to the crank angle are shifted forward or backward in relation to the crankshaft angle. As a result, simulated gas criteria are on hand for the relevant control range, in particular the tolerance range of a camshaft position. The tolerance range can be +/−5° and, in particular, also +/−3°.

Modeling methods or modeling aids for these simulated gas criteria are likewise mathematical signal processing algorithms and systems, such as: Gaussian process models, neural networks, polynomial models, and inverse FFT (Fast Fourier Transform). What is important here is that the family of simulated gas criteria has the same characteristics as the ACTUAL gas criterion derived from the gas signal.

In a next step, the ACTUAL gas criterion is then compared with the simulated gas criteria. In this process, one of the simulated gas criteria that has the least deviation from the gas criterion is determined. This determination likewise takes place with the aid of statistical/mathematical methods, as for example: averaging, median calculation, evaluation of a standard deviation. In this way, the simulated gas criterion that has the least deviation from the ACTUAL gas criterion can be determined. For this simulated gas criterion with the least deviation, it is possible to determine an ACTUAL camshaft position that corresponds to the simulated gas criterion with the least deviation from the ACTUAL gas criterion.

In a next step, the deviation or the difference between this determined ACTUAL camshaft position and the detected camshaft position (belonging to the ACTUAL gas signal) can then be determined. This difference characterizes the deviation between the ACTUAL camshaft position and the detected camshaft position. This difference can stem from, e.g., signs of wear and the replacement of components or from changes in the crankshaft/camshaft/valve system. From this difference, it is then possible to determine a camshaft position correction value that serves to determine corrected camshaft positions in that detected camshaft positions are corrected by the identified camshaft position correction value.

The application of the camshaft position correction value to the detected camshaft positions then re-establishes high agreement between the camshaft position thus corrected and an ACTUAL camshaft position that belongs to the detected ACTUAL gas signal. In this way, it is possible to correct or to adapt camshaft positions during vehicle operation in a simple and very reliable manner.

In this context, methods exist in which the corrected camshaft positions of an intake camshaft and/or of an exhaust camshaft are determined. By means of the choice or the combination of corrected camshaft positions, the charge exchange can be corrected especially accurately, or by means of the selection of a camshaft position correction, the method can be simplified accordingly, without greater inaccuracies arising in the determination of the charge gas quantity or exhaust gas quantity. In particular, the application of the method to an intake camshaft ensures the accurate determination of the charge gas quantity or fresh air quantity necessary for the essential exhaust variables.

In this context, methods exist in which a valve position criterion that relates to an intake valve and/or an exhaust valve is also modeled in addition to the determination of a corrected camshaft position. Such valve position criteria can be further adjustment options in which not only the setting angle, which is to say the camshaft position or the phase angle of the camshaft, is set, but also additional setting parameters that can affect the valve stroke profile. In this way, additional changes to the valve control (control profile, control times) can be achieved that go beyond a simple phase shifting through setting of the camshaft.

In this context, methods exist in which the modeling of a valve position criterion is supplemented by the modeling of an air charge or a fresh air charge on the basis of the valve position criteria. In this way, the cylinder charge or the fresh gas charge can be achieved with particular accuracy and repeatability.

Methods exist in which the detected camshaft position is determined in relation to a crankshaft position by means of a camshaft position sensor arrangement and a crankshaft position sensor arrangement. With the aid of such sensor arrangements, variables can be matched exactly to a crankshaft position.

In this context, methods exist in which the crankshaft position sensor arrangement or the camshaft position sensor arrangements include one of the following sensors: inductive speed sensor, differential Hall sensor, AMR sensor, Hall phase sensor. Such sensors, typically referred to as engine speed sensors or speed transmitters, are beneficial for engine management. Both the engine speed and the angular position of the crankshafts, and thus also the stroke position of the engine pistons, can be determined with them.

In addition, they permit an accurate identification of the operating cycle position in four-stroke engines (0 to 720 degrees crankshaft angle) in that the position of the camshaft in relation to the crankshaft is detected. As a rule, magnetic field changes are generated through pulse generator wheels in this case. In this way, the number of generated pulses increases with increasing speed. The sensors can either operate inductively or by using the Hall effect or as AMR sensors (Anisotropic Magneto-Resistance sensors). Hall phase sensors are used in conjunction with adjustable camshafts. Phase sensors are also used to indicate the position of the crankshaft in relation to a camshaft position. With these, it is possible to make the important distinction as to whether an engine piston that is moving upward is in the compression stroke or in the exhaust stroke. This information can be important for identifying the adjustment angle of the camshaft (camshaft position).

Methods exist in which the ACTUAL gas signal is an ACTUAL pressure signal. The pressure behavior in the air intake tract or in the exhaust tract can be detected especially easily by pressure sensors.

Methods exist in which the ACTUAL gas signal is an ACTUAL volume flow signal, which likewise must be detected very accurately and with high resolution. With these, it is possible to detect signal behaviors that correlate with the valve position behavior. In this context, methods exist in which the ACTUAL gas signal is detected as an intake pipe pressure behavior signal in an intake manifold (air intake tract).

Methods also exist in which the ACTUAL gas signal is detected as an exhaust pipe pressure behavior signal in an exhaust manifold (exhaust tract). In this case, the sensing of the pressure in the intake manifold or in the exhaust manifold is especially helpful, since the pressure behaviors are then detected close to the intake or exhaust valves, and thus a high correlation exists between the valve behavior (and camshaft motion) and the detected gas signal.

In this context, methods exist in which the processing of the gas signal to produce a gas criterion is accomplished by means of a signal filtering method, in particular using one of the following methods: FFT (Fast Fourier Transform) filtering method, bandpass filtering method. These methods permit simple data reduction, but at the same time ensure that relevant and characteristic signal data are preserved.

Methods exist in which the generation of the simulated gas criteria is accomplished by means of a computer-implemented modeling method or system. In this case, the following can be used, in particular: neural networks, Gaussian process models, polynomial models, inverse FFT, additional empirical or physics-based models. These methods allow the simulation of the gas criteria such that they compare well with the identified gas criteria, and characteristic variables correspond to one another.

Methods exist in which one of the following computer-implemented comparison methods is performed in order to determine the ACTUAL camshaft position: cross-correlation method, standard deviation, averaging. These methods are statistical evaluation methods that can be applied especially simply and accurately, and that make it possible to determine the agreement between the identified gas criteria and the simulated gas criteria.

The invention also relates to a control unit that is equipped and designed to carry out the method according to the invention. In such a control unit, both the necessary signal processing steps and the necessary comparison algorithms can be performed. In addition, the necessary stored data must be kept available in a fixed or variable fashion in such a control unit.

An internal combustion engine with a control unit suitable for setting a gas quantity makes it possible to carry out the matching of a camshaft adjustment and the gas exchange control that is dependent thereon in a self-correcting and more or less self-adaptive manner. As a result, changes caused by wear and/or maintenance can be corrected without resource-intensive additional measurements and matchings.

The method according to the invention can be realized in a vehicle having such an internal combustion engine. And low-emission and load-optimized vehicle operation can be realized over the long term.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
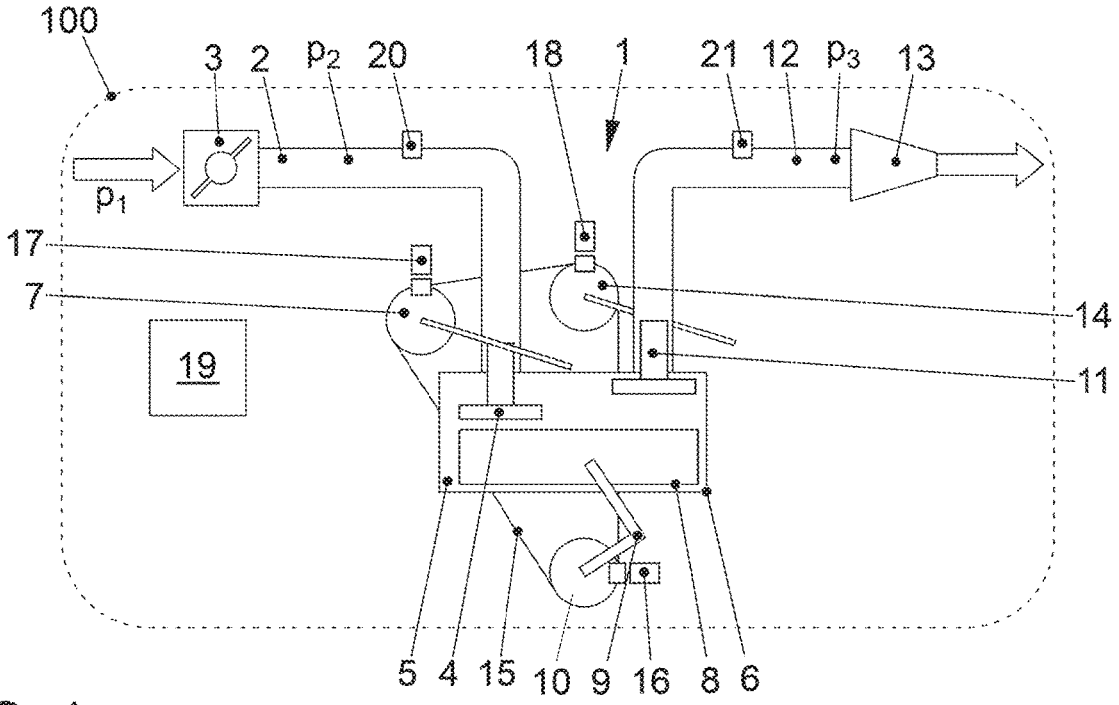
FIG. 1 is a schematic representation of a motor vehicle with an internal combustion engine for carrying out the method according to the invention.

In a schematic representation, FIG. 1 shows a vehicle 100 with an internal combustion engine 1 that has the following: fresh air or fresh gas is carried into the combustion chamber 5 of the cylinder 6 through an intake manifold 2, which runs between a throttle valve 3 and an intake valve 4. The motion of the intake valve 4 is controlled through the adjustable intake camshaft 7. Fuel is mixed with the supplied fresh air in the cylinder 6 or in the intake manifold 2 and is combusted in the cylinder, driving the piston 8 in the process. The piston movement is transmitted by the crank 9 to the crankshaft 10, whose rotary motion is used by means of a drive train to drive the vehicle 100.

Following the combustion, the piston 8 pushes the exhaust gas out of the combustion chamber 5 through the exhaust valve 11 into the exhaust manifold 12, whence it continues through the turbine 13 of an exhaust turbocharger, which may optionally be equipped with a wastegate valve or a variable turbine geometry. The exhaust valve 11 is driven by the exhaust camshaft 14. The crankshaft 10 drives the exhaust camshaft 14 and the intake camshaft 7 through a drive belt 15, and thus also operates the intake valve 4 and the exhaust valve 11.

The rotary motions of the crankshaft 10 are detected by a crankshaft sensor 16, and the rotary motions of the camshafts 7, 14 are detected by an intake camshaft sensor 17 and an exhaust camshaft sensor 18, respectively. These sensors provide corresponding signals to an engine control unit 19. One or more gas signal sensors 20, 21 for detecting a gas signal or a signal behavior $S_{ACT}$ are arranged in the region of the intake manifold or in the region of the exhaust manifold. In the present example, these are pressure sensors, which detect an intake pressure $p_2$ and an exhaust gas back pressure $p_3$, respectively.

In other embodiments, the corresponding gas signals $S_{ACT}$ can also be a volume flow rate or a temperature behavior, which then are detected and recorded by other suitable, corresponding sensors, and are provided to the engine control unit 19.

The sequence of the method is now explained by way of example on the basis of FIGS. 2 to 6. The block diagram shows a detection control block A, which is present in a production engine control unit 19, and a special control block B, which is provided specifically for implementing the method according to the invention.

First, an adaptation release takes place in block B1. For this purpose, a defined operating state of the internal combustion engine 1 is queried. For this purpose, the engine is in an operating state in which no fuel is being supplied or injected. In addition, the operating positions of the throttle valve 3 and of any wastegate valve that may be present, or the position of a variable turbine geometry, are queried, all of which must be within a defined range. The ambient pressure $p_1$ and the temperature $T_2$ in the intake pipe must also be within a defined range. Furthermore, the engine speed n must likewise be within a specified speed range. For this purpose, the speed signals of the crankshaft sensor 16 and (if a temperature sensor is present) a temperature signal $T_1$ are queried, and the ambient pressure $p_1$ (outside of the intake pipe) is determined. If the appropriate conditions are present, pressure detection is carried out in block A1. A corresponding detected signal of the pressure sensor 20 in the intake manifold 2 or the exhaust manifold 12 serves this purpose.

Figure 3:
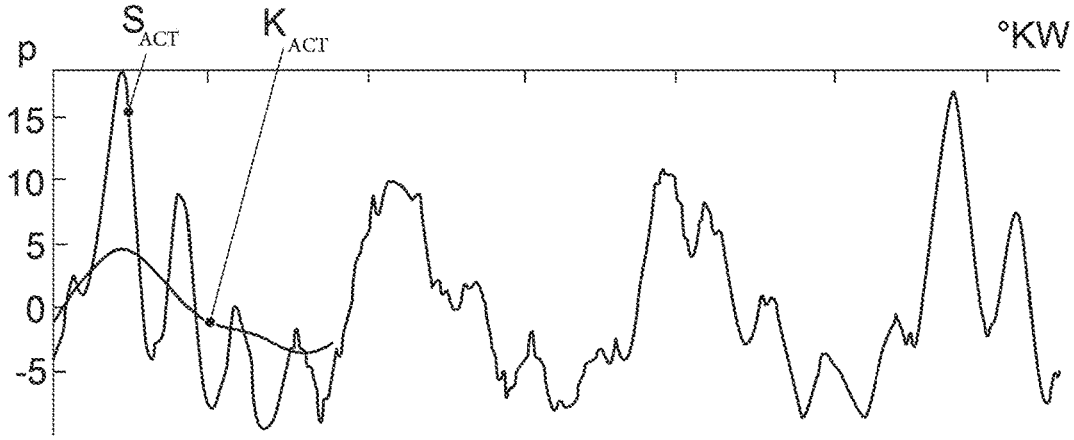
FIG. 3 shows the signal behavior of an ACTUAL pressure signal and ACTUAL pressure criterion.

The corresponding signal behavior for this ACTUAL gas signal $S_{ACT}$ is shown in FIG. 3. In the filter component B2, this gas signal $S_{ACT}$ is then processed by means of an electronic filter (for example a bandpass filter, an FFT filter, or the like) and is output as an ACTUAL gas criterion. The behavior of the ACTUAL gas criterion is shown in FIG. 3, and exhibits a significantly reduced information and data density, but allows characteristic signal data to be examined.

Figure 4:
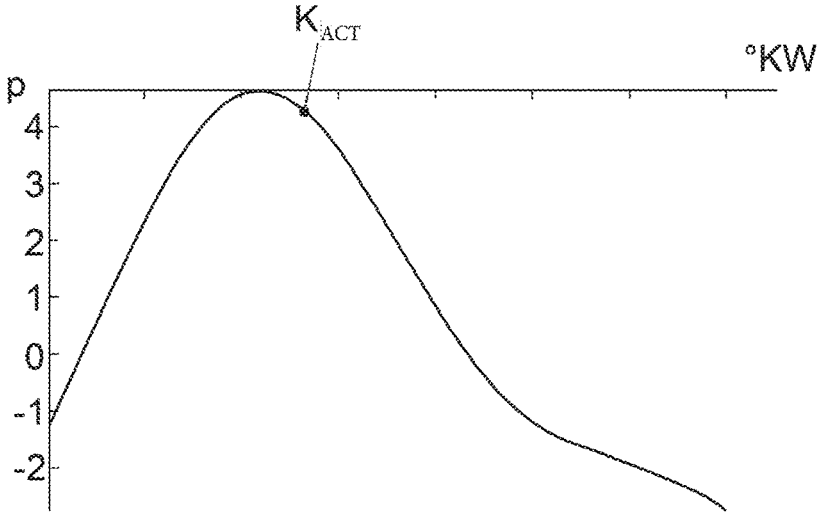
FIG. 4 shows the ACTUAL pressure criterion.

FIG. 4 shows the behavior of the ACTUAL gas criterion in isolation. The behaviors in FIG. 3 and FIG. 4 are each plotted over crankshaft angle. The ACTUAL gas criterion $K_{ACT}$ is carried over into a comparison block B5.

For the comparison, a gas criterion $K_{SIM}$ is then modeled in the modeling block B4, namely taking into account the data for the operating point at which the ACTUAL gas criterion $K_{ACT}$ has been identified. This information on the operating point or on the reference model is provided by the control block B3. A gas criterion family $K_{SIM1\text{-}n}$, which is derived from the simulated gas criterion $K_{SIM}$, is formed in block B4 in that simulated gas criteria $K_{SIM}$ are modeled for different camshaft positions $Cam_{SIM}$. In this process, the camshaft position is varied virtually between a maximum position $Cam_{SIMmax}$ and a minimum position $Cam_{SIMmin}$. The following can be employed for modeling the gas criterion family $K_{SIM1\text{-}n}$: neural networks, Gaussian process models, polynomial models, inverse FFT (Fast Fourier Transform), etc.

Figure 5:
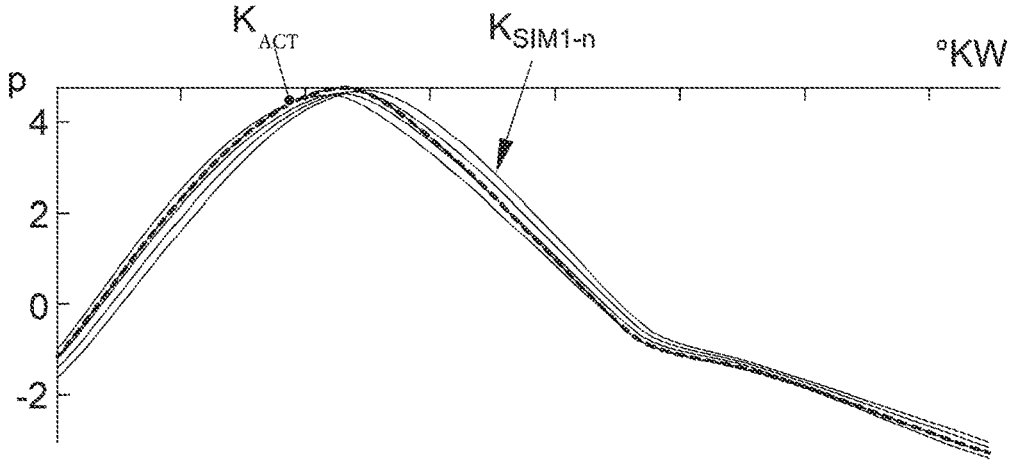
FIG. 5 shows the ACTUAL pressure criterion together with a family of simulated pressure criteria.

This gas criterion family $K_{SIM1\text{-}n}$ thus produced is delivered to the comparison block B5, where it is compared with the detected ACTUAL gas criterion (see FIG. 5). The ACTUAL gas criterion (filtered gas signal) $K_{ACT}$ is compared with all simulated gas criteria $K_{SIM}$. Suitable comparison methods are cross-correlation methods, the standard deviation, and the averaging of the differences between the simulated gas criteria $K_{SIM}$ and the ACTUAL gas criterion $K_{ACT}$.

Figure 6:
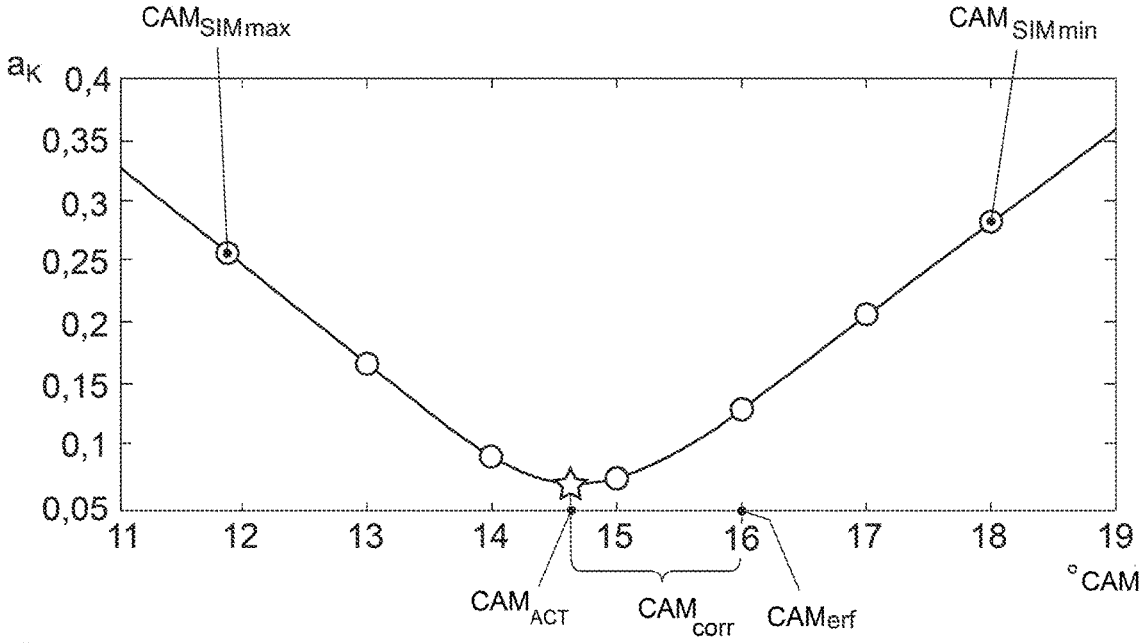
FIG. 6 shows the behavior of the standard deviation of the differences between individual pressure criteria and the ACTUAL pressure criterion for determining a camshaft position correction value.

FIG. 6 shows the analysis for a standard deviation $a_k$. The curve shown is produced in this case from the standard deviations of the differences between different simulated gas criteria $K_{SIM}$ and the ACTUAL gas criterion. Here, the minimum of the curve between the adjustment angles of 14 and 15 degrees of the camshaft position provides the real ACTUAL camshaft position $Cam_{ACT}$ for the operating state with the detected camshaft position $Cam_{det}$ for which the ACTUAL gas criterion $K_{ACT}$ was determined. Thus, the camshaft position correction value $Cam_{corr}$ results from the difference between the detected camshaft position and the determined ACTUAL camshaft position $Cam_{ACT}$. All detected camshaft positions can now be corrected with this value so that they correspond to the real ACTUAL camshaft position, on the basis of which the appropriate control data can then be retrieved.

Figure 2:
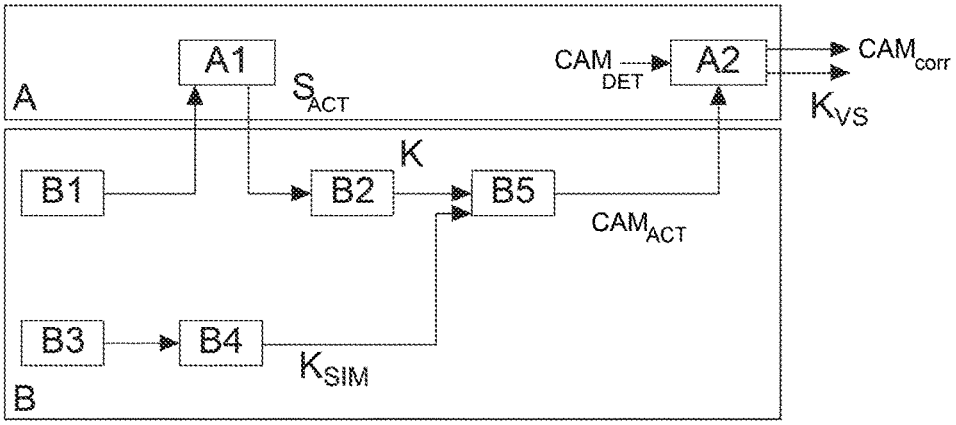
FIG. 2 is a schematic block diagram with the individual function blocks for carrying out the method according to the invention.

Additional variations and exemplary embodiments are evident to the person skilled in the art on the basis of the claims. In addition to the pressure behaviors described above, temperature behaviors and/or volume flow rates can also serve as gas signals. The method described here using the example of an intake camshaft can also be applied to an exhaust camshaft. It is also possible to apply the above-described method to other adjustment arrangements for control and adjustment arrangements of the intake and exhaust valves, and thus to derive appropriate valve position criteria $K_{VS}$ in block A2 (FIG. 2).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for adaptation of a detected camshaft position of a camshaft in an internal combustion engine, the method comprising:

detecting an ACTUAL gas signal in a gas space that is associated with the camshaft and is associated with a detected camshaft position;

processing the gas signal to produce an ACTUAL gas criterion;

modeling multiple simulated gas criteria, which are associated with a target camshaft position;

comparing the simulated gas criteria with the ACTUAL gas criterion;

determining a simulated gas criterion with the least deviation from the ACTUAL gas criterion;

determining an ACTUAL camshaft position that corresponds to the simulated gas criterion with the least deviation from the ACTUAL gas criterion;

determining a camshaft position correction value from the difference between the ACTUAL camshaft position determined and the detected camshaft position; and determining at least one corrected camshaft position by correcting the detected camshaft positions with the camshaft position correction value.

2. The method according to claim 1, wherein the at least one corrected camshaft positions of an intake camshaft and/or an exhaust camshaft is determined.

3. The method according to claim 1, further comprising:

modeling a valve position criterion of an intake and/or exhaust valve on the basis of the corrected camshaft positions.

4. The method according to claim 3, further comprising:

modeling a gas charge on the basis of the modeled valve position criteria.

5. The method according to claim 1, wherein the detected camshaft position is determined in relation to a crankshaft position via a camshaft and crankshaft position sensor arrangement.

6. The method according to claim 4, wherein the camshaft and/or crankshaft position sensor arrangement includes an inductive speed sensor, a differential Hall sensor, a AMR sensor, and/or a Hall phase sensor.

7. The method according to claim 1, wherein the ACTUAL gas signal is an ACTUAL pressure signal.

8. The method according to claim 1, wherein the ACTUAL gas signal is detected as an intake pipe pressure behavior signal in an intake manifold.

9. The method according to claim 1, wherein the ACTUAL gas signal is detected as an exhaust pipe pressure behavior signal in an exhaust manifold.

10. The method according to claim 1, wherein the processing of the ACTUAL gas signal to produce a gas criterion is accomplished via a signal filtering method, a FFT filtering method, or a bandpass filtering method.

11. The method according to claim 1, wherein the generation of the simulated gas criteria is accomplished via a computer-implemented modeling method, a neural network, a Gaussian process model, a polynomial model, or an inverse FFT.

12. The method according to claim 1, wherein at least one of the following computer-implemented comparison methods is performed in order to determine an ACTUAL camshaft position: a cross-correlation method, a standard deviation, or an averaging.

13. An engine control unit adapted to carry out the method according to claim 1.

14. An internal combustion engine comprising:

an intake valve arrangement and an exhaust valve arrangement for setting a gas quantity; and an engine control unit according to claim 13.

15. A vehicle comprising an internal combustion engine according to claim 14.

* * * * *